United States Patent [19]

Yamada et al.

[11] 4,416,196

[45] Nov. 22, 1983

[54] TYING MACHINE

[75] Inventors: Masatoshi Yamada; Takaji Fuse, both of Funabashi, Japan

[73] Assignee: Yamada Kikai Kogyo Kabushiki Kaisha, Chiba, Japan

[21] Appl. No.: 426,952

[22] Filed: Sep. 29, 1982

Related U.S. Application Data

[63] Continuation-in-part of Ser. No. 244,977, Mar. 18, 1981, abandoned.

[51] Int. Cl.[3] ..... B65B 13/20

[52] U.S. Cl. ..... 100/7; 100/3; 100/153; 100/295

[58] Field of Search ..... 100/3, 7, 17, 18, 19 R, 100/153, 295

[56] References Cited

U.S. PATENT DOCUMENTS

| | | | |
|---|---|---|---|
| 1,597,697 | 8/1926 | Saxton et al. | 100/7 X |
| 1,606,290 | 11/1926 | Bunn | 100/7 |
| 3,198,105 | 8/1965 | Smith | 100/3 |
| 3,220,337 | 11/1965 | Goland et al. | 100/7 |
| 3,511,173 | 5/1970 | Morrow | 100/7 |
| 3,515,056 | 6/1970 | Johnson | 100/3 X |
| 4,090,441 | 5/1978 | Muller | 100/7 |
| 4,201,127 | 5/1980 | Pasic | 100/3 X |

FOREIGN PATENT DOCUMENTS

| | | | |
|---|---|---|---|
| 55-52815 | 4/1980 | Japan | 100/3 |

*Primary Examiner*—Billy J. Wilhite

*Attorney, Agent, or Firm*—Diller, Ramik & Wight

[57] ABSTRACT

A tying machine comprising a bundle shaping unit including a pair of side aligning plates and a roller press which enables the bundle to be tied to move in a feeding direction while exercising a compressing force upon the bundle which has had its sides aligned by the side aligning plates. The tying machine also comprises a tying unit including a pair of oppositely disposed tying devices and press means which exercises a compressing force upon the bundle during the tying operation. The bundle to be tied is fed from the bundle shaping unit to the tying unit one by one upon completion of each cycle of the bundle shaping operation of the bundle shaping unit.

16 Claims, 11 Drawing Figures

TYING MACHINE

This application is a continuation-in-part application of pending application Ser. No. 244,977 filed on Mar. 18, 1981 in the name of Masatoshi Yamada and Takaji Fuse entitled TYING MACHINE and now abandoned.

BACKGROUND AND SUMMARY OF THE INVENTION

This invention relates to a tying machine and, more particularly, to a tying machine capable of tying up bundles, packages and parcels and particularly suitable for tying up a bundle of material such as cardboard piled in a stack.

For conveying a bundle such as a stack of cardboard, a belt conveyer system of a kicker type chain conveyer system has heretofore been employed in known tying machines. The recent tendency to increasing the operation speed of tying machines has, however, given rise to various problems in the employment of these known conveyer systems.

A major problem is that increase in the conveying speed causes deformation in the bundle, especially in the case of a stack of cardboard, which results in collapse of the bundle or falling off of a part of the material to be tied from the bundle before starting of the tying operation. Even if the bundle is aligned on their sides relative to the moving direction of the conveyer belt by provision of a side aligning device, the bundle after being tied up does not always present a good appearance because of deformation which frequently takes place in the course in which the bundle is being conveyed to the tying device.

It is, therefore, an object of the present invention to eliminate the above described disadvantages of the prior art tying machines by providing a tying machine capable of conveying the bundle without occurrence of collapse or deformation of the bundle during the high speed operation.

It is another object of the invention to provide a tying machine which comprises a bundle shaping unit including side aligning means for aligning sides of a bundle to be tied, a tying unit including a pair of tying devices disposed opposite to each other for tying a string around the bundle and press means exercising a compressing force upon the bundle to be tied during the tying operation effected by said tying devices and a feeding device for stopping the bundle during the operation of said bundle shaping unit and feeding the bundle from said bundle shaping unit to said tying unit one by one upon completion of each cycle of the operation of said bundle shaping unit.

Other objects and features of the invention will become apparent from the description made hereinbelow with reference to the accompanying drawings.

DESCRIPTION OF PREFERRED EMBODIMENTS

Figure 1:
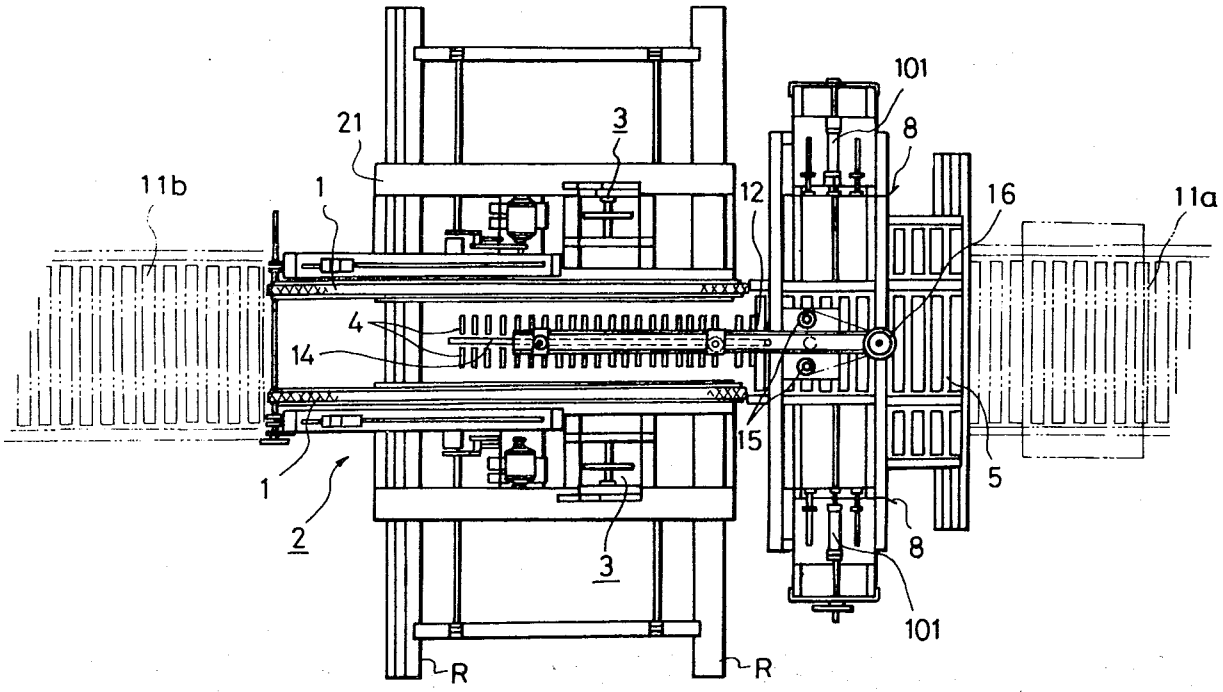
FIG. 1 is a plan view of an embodiment of the tying machine made according to the invention.
Figure 2:
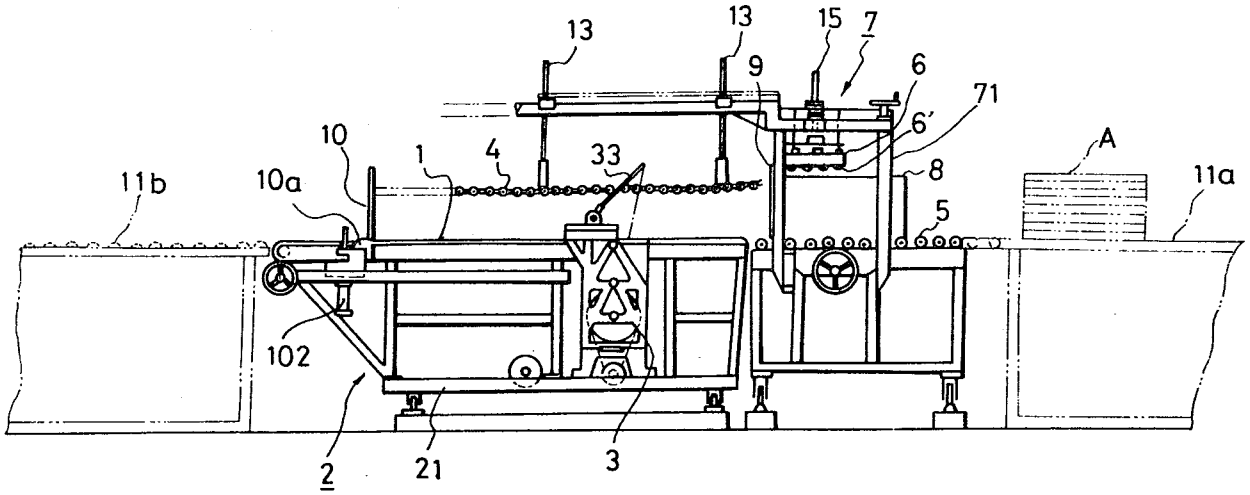
FIG. 2 is a side elevational view of the embodiment shown in FIG. 1.

Referring first to FIGS. 1 and 2, the first embodiment of the present invention will be described.

A pair of frames 21, 21 which are movably mounted on a pair of rails R, R are positioned in a desired location on the rails R, R by means of a displacing device 130 and extend upwardly from the rails R, R. The displacing device 130 includes a pair of oppositely threaded bars 131 and 132 which are connected by a coupling 133 and engage in corresponding threaded openings (not shown) formed in the frames 21, 21 and a handle 134 which is secured to the threaded bar 132 for rotating the same. A pair of belt conveyers 1, 1 are provided on the frames 21, 21 on the opposite sides of the frames 21, 21, the conveyer surfaces of these belt conveyers 1, 1 being disposed on a higher plane than the upper surfaces of the frames 21, 21. There is also provided on the frames 21, 21 a tying unit 2 which comprises a pair of tying devices 3 provided in an opposite relation to each other, each of the tying devices 3,3 being capable of tying the bundle without rotating a wrapping arm as will be described more fully later with reference to FIGS. 4A and 4B. The frames 21, 21, the belt conveyers 1, 1, and the tying devices 3, 3 mounted on the frame 21, 21 can be respectively moved to and away from each other by turning the handle 134 whereby two tying positions on a bundle to be tied by the pair of tying devices 3, 3 can be adjusted at will.

A free roller conveyer 4 is provided between and above the pair of belt conveyers 1, 1 in parallel therewith in the manner to be described later. On the charge side of the tying unit 2 is provided a drive roller conveyer 5 which is on the same plane as the belt conveyers 1, 1 and also is provided a press 7 which has a roller carrier 6 confronting the drive roller conveyer 5 in parallel and carrying a plurality of free rollers 6'. The free rollers 6' of the press 7 respectively have an axis which is parallel to the axes of the rollers of the drive roller conveyer 5.

In the section of the conveyer 5 where the press 7 is located thereabove, a pair of side aligning plates 8,8 are provided, which plates 8, 8 are actuated by air cylinders 101, 101, as will be described later. The press 7 and the side aligning plates 8, 8 constitute a bundle shaping unit in the tying machine according to the invention. A stopper 9 is provided between the discharge end of the portion of the drive roller conveyer 5 and the tying unit 2 in such a manner that the stopper 9 is vertically displaced by actuation of an air cylinder (not shown) between its uppermost position illustrated in FIG. 2 and a lowermost position below the plane of the drive roller conveyer 5. Likewise, a stopper 10 is provided on the discharge side of the tying unit 2 in such a manner that the stopper will be vertically displaced between its uppermost position shown in FIG. 2 and its lowermost position below the belt conveyers 1 by actuation of an air cylinder 102 to which the stopper 10 is connected through a pinion and rack mechanism 10*a*. A roller conveyer 11*a* is provided on the charge end of the drive roller conveyer 5 and a roller conveyer 11*b* on the discharge end of the belt conveyers, 1, 1 for feeding in and out the bundle.

Figure 3:
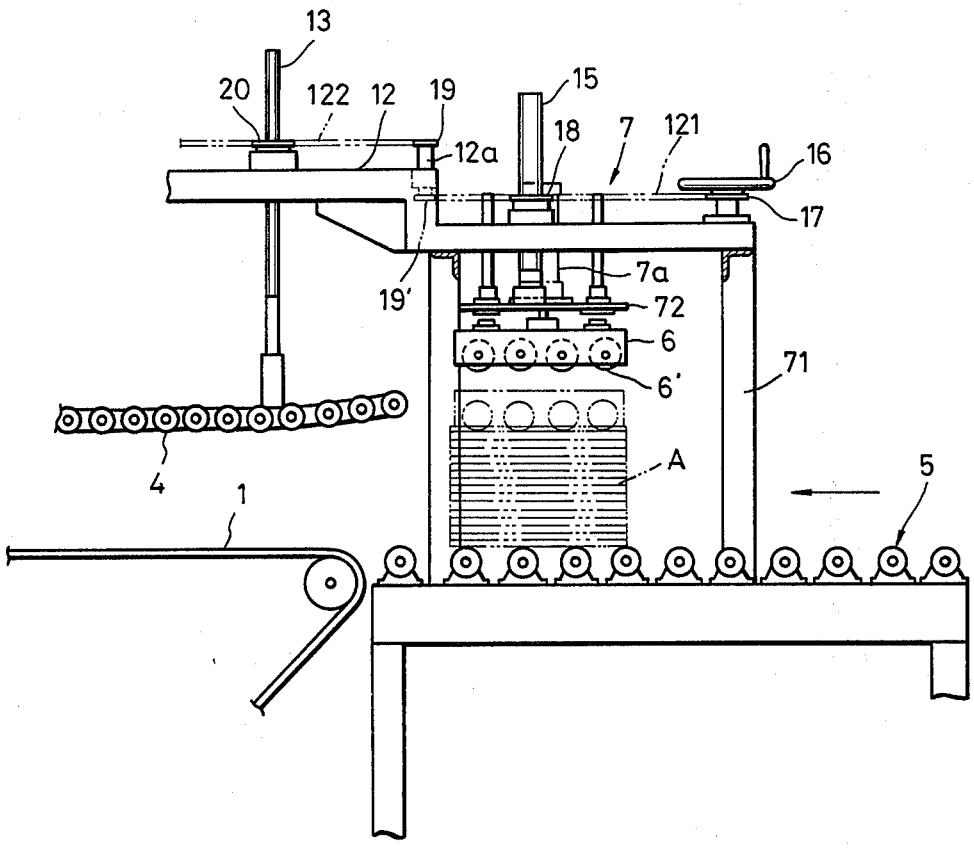
FIG. 3 is a side elevational view showing a charge end of a conveyer and a press in an enlarged scale.

The charge end portion of the free roller conveyer 4 and the press 7 are shown in detail in FIG. 3.

A beam 12 is mounted on a frame 71 of the press 7. The beam 12 extends horizontally toward the tying unit 2. A plurality of adjusting screw rods 13 are threadedly engaged with the beam 12 and a support bar 14 for supporting the conveyer 4 is secured to the lower ends of the adjusting screws rods 13. A pair of adjusting screw rods 15 are in threaded engagement with the upper portion of the frame 71. A support plate 72 supporting an air cylinder 7*a* is secured to the lower ends of these adjusting screws rods 15. The output shaft of the air cylinder 7*a* is secured to the upper surface of the roller carrier 6. A sprocket 17 is provided on the shaft of an adjusting handle 16. Sprockets 18 and 20 are provided on the adjusting screw rods 15 and 13. Sprockets 19, 19' are also provided on a stud 12*a* fixedly secured to the beam 12. A chain 121 is provided around the sprockets 17, 18 and 19' and a chain 122 is provided around the sprockets 19 and 20. The adjusting screw rods 15 and 13, therefore, are interlocked with each other and the conveyer 4 is controlled in its height in accordance with the height of the roller carrier of the press 7 by manually operating the handle 16.

For facilitating feeding of the bundle A to the belt conveyers 1, 1, the charge end of the free roller conveyer 4 is tapered upwardly and is spaced from the belt conveyers 1, 1 by a distance which is slightly larger than the height of the bundle A compressed by the press 7. The distance between the roller 4 and the belt conveyers 1, 1 in the rest of the roller 4 is the same as the height of the bundle A.

Figure 4A:
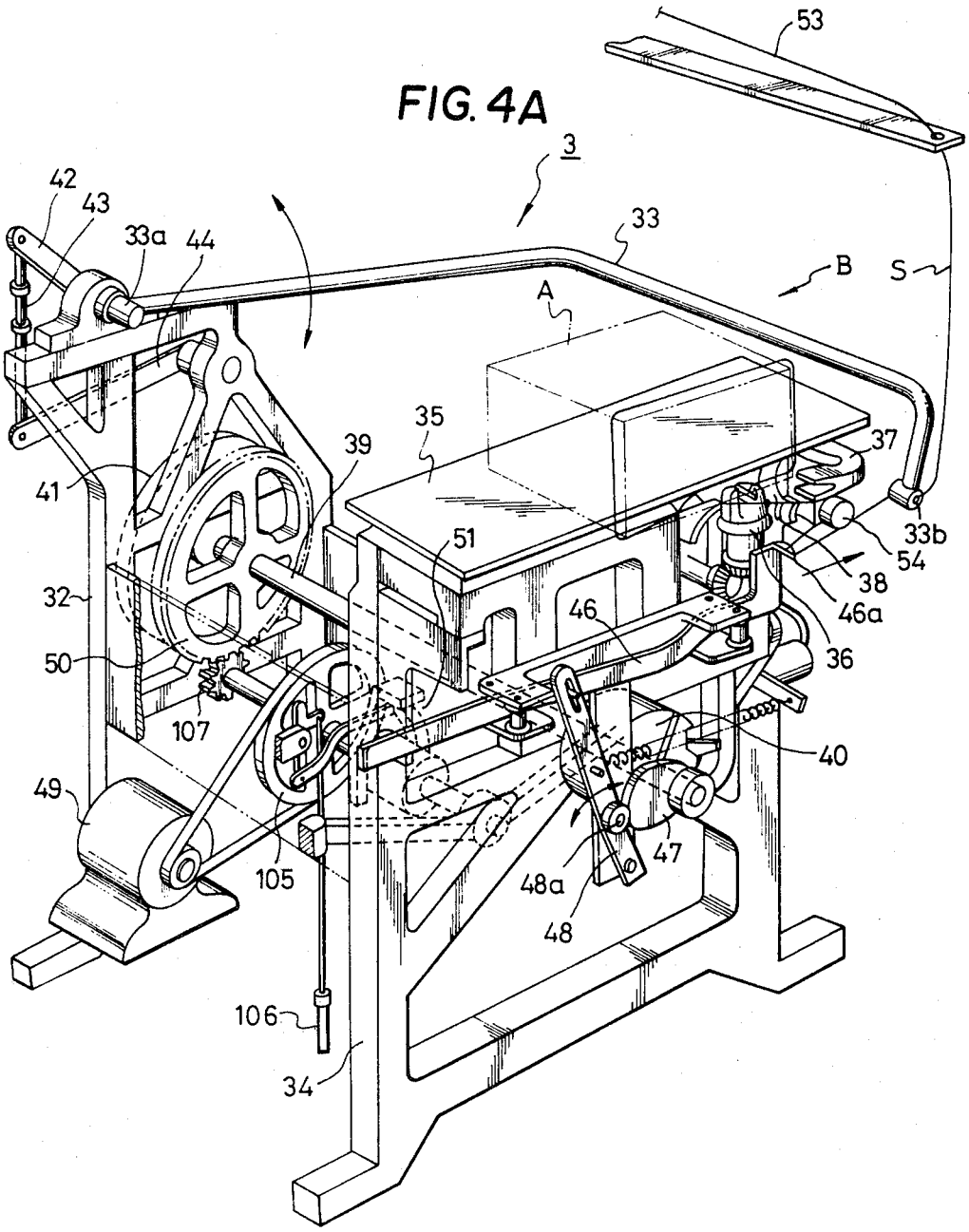
FIG. 4A is a perspective view of a tying device employed in the embodiment of the present invention.
Figure 4B:
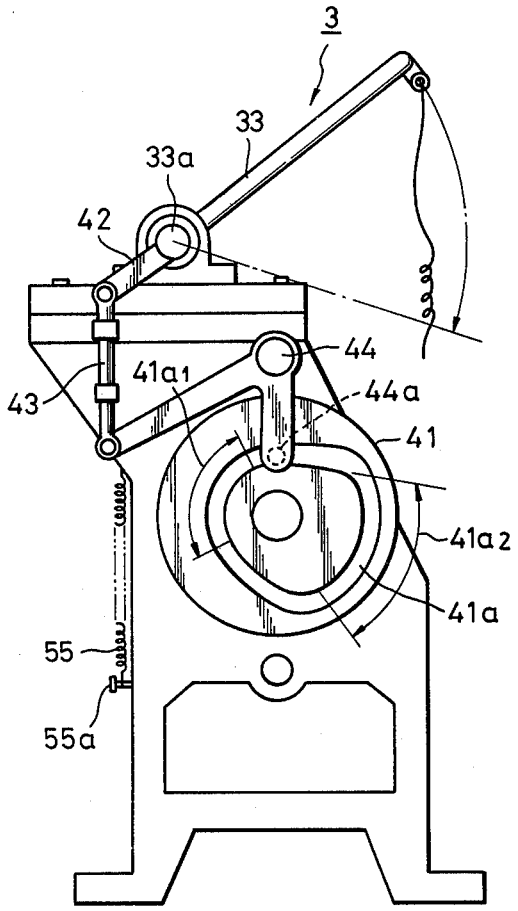
FIG. 4B is a side elevational view of the tying device shown in FIG. 4A.
Figure 5:
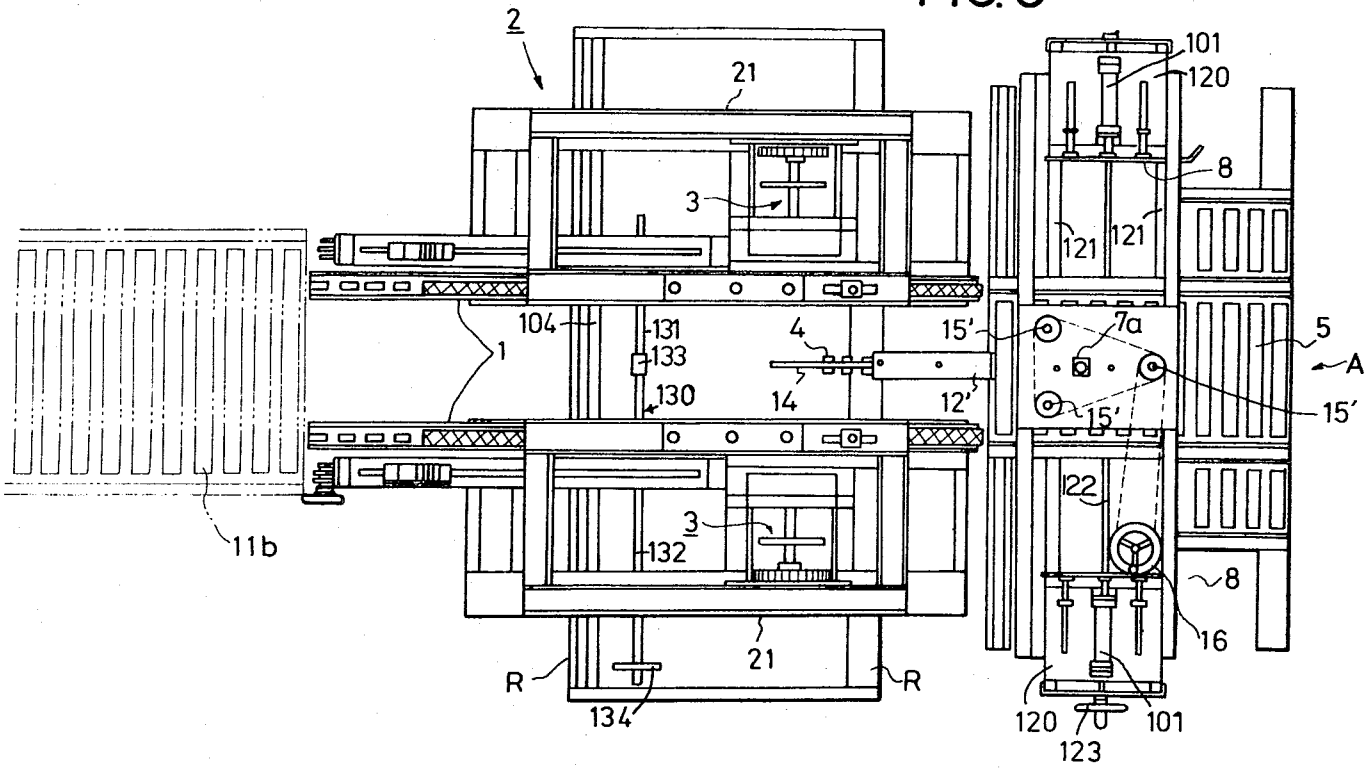
FIG. 5 is a plan view of another embodiment of the tying machine made according to the invention.

An example of the tying unit 2 employed in the invention is illustrated in detail in FIGS. 4A and 4B.

Referring to FIG. 4A, a pair of side frames 32 and 34 are mounted on the frame 21. A pin 33*a* of a wrapping arm 33 is pivotally supported at the upper end portion of the side frame 32. A table 35 is mounted on the other side frame 34. On the outer surface of the side frame 34 are mounted a beak 36 and a forked lever 37 for tying a knot and a cutter 38 for cutting the string. The beak 36, the lever 37 and the cutter 38 are of the same type as those provided in conventional tying machines and these parts provided for the tying of a knot are actuated in a predetermined sequence by means of a cam 40 provided at the end of a cam shaft 39.

A cam 41 provided at the other end of the cam shaft 39 is formed with a groove 41*a* (FIG. 4B). A roller 44*a* provided at the end portion of one arm of a bell crank lever 44 is engated in the groove 41*a*. The bell crank lever 44 has its other arm pivotally connected to a rod 43 which in turn is pivotally connected to the end of a lever 42 secured rigidly to the pin 33*a* of the wrapping arm 33. A tension spring 55 is provided between the end portion of the arm of the lever 44 connected to the rod 43 and a pin 55*a* secured to the side frame 32. This spring 55 urges the roller 44*a* to the groove 41*a* of the cam 41.

The groove 41*a* consists of an arcuate portion 41*a*1 which is of a small radius and formed concentrically with the cam 41, an arcuate portion 41*a*2 which is of a large radius and formed concentrically with the cam 41 and gradually curved portions connecting these arcuate portions 41*a*1 and 41*a*2. When the roller 44*a* is engaged in the arcuate portion 41*a*1, the wrapping arm 33 is held in its lifted position, whereas when the roller 44*a* is engaged in the arcuate portion 41*a*2, the arm 33 is held in its lowered position.

The cam 40 is formed in such a manner that it will actuate the beak 36, the lever 37 and the cutter 38 while the roller 44*a* is in engagement with the arcuate portion 41*a*2.

A string catching bar 46 has a projection 46*a* and is moved in a reciprocating motion by a lever 48 which swings as indicated by arrows on a pin 48*a* which in turn is contacted by a cam 47 secured to the cam shaft 39. Driving force of an electric motor 49 is transmitted to the cam shaft 39 through a pulley 105, a clutch 51 actuated by an air cylinder 106, a pinion 107 and a gear 50. In FIG. 4A, reference numeral 53 denotes a string guide and reference numeral 54 a string holder.

The tying operation by the above described tying unit 2 will now be described.

Assume that the wrapping arm 33 is now in the lifted position. A string S is extended in front of the bundle to be tied through an opening 33*b* of the wrapping arm 33 and is held in the end portion thereof by the string holder 54.

If the bundle A is fed from this state in the direction of arrow B, the string S is fed out as the bundle A moves and passes from the front surface of the bundle A through between the bottom surface of the bundle A and the table 35, thus wrapping a substantial part of the bundle A. Then, the clutch 51 is engaged and the cam shaft 39 thereby is rotated by 360°. This causes the wrapping arm 33 to move in a pivotal motion downwardly through the movement of the cam 41 and thereby wrap the bundle A completely as illustrated in FIG. 4A. The string catching bar 46 is withdrawn to cause a portion of the string S between the end of the wrapping arm 33 and the bundle A to be pinched by the string holder 54.

The forked lever 37, the beak 36 and the cutter 38 are subsequently actuated to effect tying of a knot, cutting of the string and pulling of the string out of the string holder 54 in the known manner as was disclosed by the specifications of U.S. Pat. No. 1,606,290 and the Japanese Patent Publication No. 7438/1976. A tying position can be adjusted by adjusting the width of the frames 21, 21.

Upon completion of the tying operation, the wrapping arm 33 is pivoted upwardly to the original lifted position and the tying unit 2 ceases the tying operation. Since there are provided a pair of tying devices 3, 3, the tying maching according to the invention can place two parallel wraps of the string around the bundle.

According to the tying machine of the invention, the bundle A fed from the conveyer 11*a* to the drive roller conveyer 5 under the press 7 is stopped on the conveyer 5 by the stopper 9. The side aligning plates 8, 8 are actuated by the air cylinders 101 to press the bundle on both sides thereof and thereby to align the bundle on their sides. Upon completion of the aligning operation, the side aligning plates 8, 8 are withdrawn away from the bundle. The cylinder 7a then is actuated to lower the press 7 and cause the free rollers 6' carried by the roller carrier 6 to be pressed against the upper surface of the bundle A.

The air cylinders 101, 101 are mounted on tables 120, 120 which are slideable along rails 121, 121. The tables 120, 120 are in threaded engagement with a threaded bar 122. By operating a handle 123 of the threaded bar 122, the tables 120, 120 are displaced altogether along the rails 121, 121 in the same direction. By this arrangement, the axis of the bundle to be aligned by the aligning plates 8, 8 can be freely adjusted.

Then the stopper 9 is lowered below the upper surface of the drive roller conveyer 5. As the drive roller conveyer 5 and the belt conveyers 1, 1 are driven with the press 7 being kept pressed against the bundle A, the compressed bundle A is transferred from the drive roller conveyer 5 to the belt conveyers 1, 1 with the upper surface of the bundle A sliding against the rotating free rollers 6'.

The bundle A transferred to the belt conveyers 1, 1 are conveyed on the belt conveyers 1, 1 while the bundle A is compressed between the belt conveyers 1, 1 and the free roller conveyer 4. By suitably determining the length of the tapered charge end of the free roller conveyer 4, the bundle can be kept compressed in being transferred from the drive roller conveyer 5 to the belt conveyers 1, 1. The bundle A is passed between the pair of tying devices 3 and, after the above described tying operation is effected, the bundle A is stopped by the stopper 10.

Since the friction between the free roller conveyer 4 and the upper surface of the bundle A is much smaller than that between each adjacent unit pieces composing the bundle A, the bundle A is conveyed between the free roller conveyer 4 and the belt conveyers 1, 1 as if the bundle A were an integral body without causing collapse or deformation of the bundle.

FIGS. 5 through 9 show another embodiment of the tying machine made according to the present invention. Throughout these figures, the same component parts as those appearing in FIGS. 1 to 3 are indicated by the same or like reference numerals and detailed description thereof will be omitted.

In the embodiment shown in FIGS. 5 to 9, a beam 12' which supports free roller conveyer 4 is secured to a support plate 72 and extends horizontally therefrom. The support plate 72 is secured to the lower ends of three adjusting screw rods 15' which are threadedly engaged in threaded apertures formed in an upper plate 71a of a frame 71.

Figure 8:
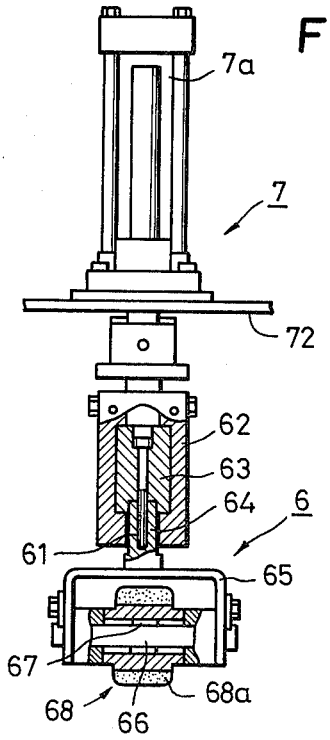
FIG. 8 is an enlarged sectional view of the press employed in the embodiment shown in FIG. 5 as viewed in the direction of the arrow A.
Figure 9:
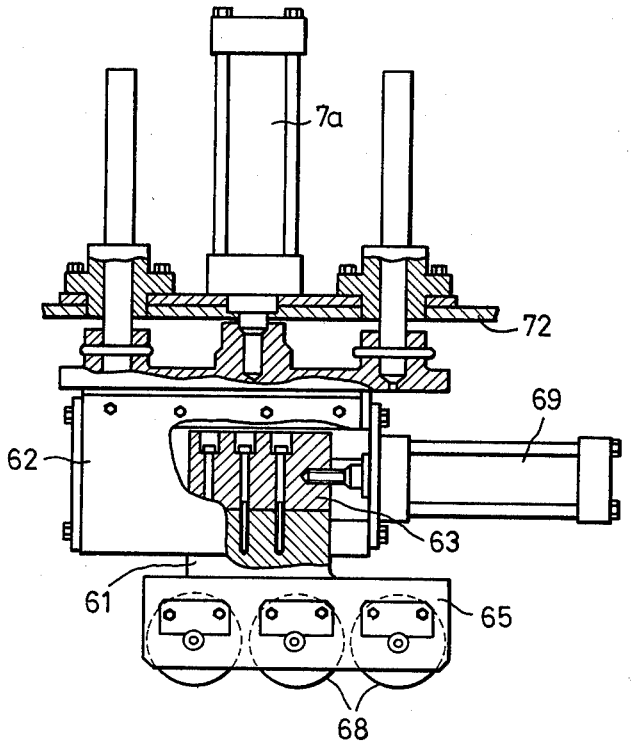
FIG. 9 is an enlarged side view of the press shown in FIG. 8 partly in vertical section.

A roller carrier 6 employed in the present embodiment is shown in detail in FIGS. 8 and 9. A slide base 62 secured to the output end of an air cylinder 7a is of a hollow rectangular cross section and is formed with an opening 61 which is perpendicular to the axes of the rollers of the drive roller conveyer 5. A slide 63 is slidably supported in the hollow portion of the slide base 62. A roller support frame 65 of an inverted U-shape in section is secured to the lower portion of the slide 63 through a connecting member 64 which is slidably engaged in the opening 61. The roller support frame 65 carries a plurality of pins 66 provided in parallel to the axes of the rollers of the conveyer 5 and rollers 68 each having a rubber contact surface 68a are mounted on the pins 66 through one-way clutches 67. On one side of the slide 63 is secured the output end of an air cylinder 69 which is mounted to one end of the slide base 62 in a direction normal to the axis of the air cylinder 7a and the axes of the rollers 68. The one-way clutch 67 permits rotation of each roller 68 only in a direction opposite to the rotation of the roller of the conveyer 5. In the embodiment shown in FIGS. 6 and 9, the roller 68 is rotatable in clockwise direction as viewed in these figures.

In the present embodiment, the frames 21, 21 have upper frame portions 21a, 21a and a pair of press devices 56, 56 are provided on the upper frame portions 21a, 21a and above the tying devices 3,3 for maintaining pressing of the bundle during the tying operation.

Each of the press devices 56, 56 has a press plate 58 which is lifted and lowered by an air cylinder 57. The press plate 58 is substantially of a rectangular configuration and has curved portions 59 on the charge and discharge ends thereof. The curved portions 59 assume a configuration of a part of a cylinder. The curved portions 59 may be provided on only one of the charge and discharge ends of the press plate 58.

Figure 6:
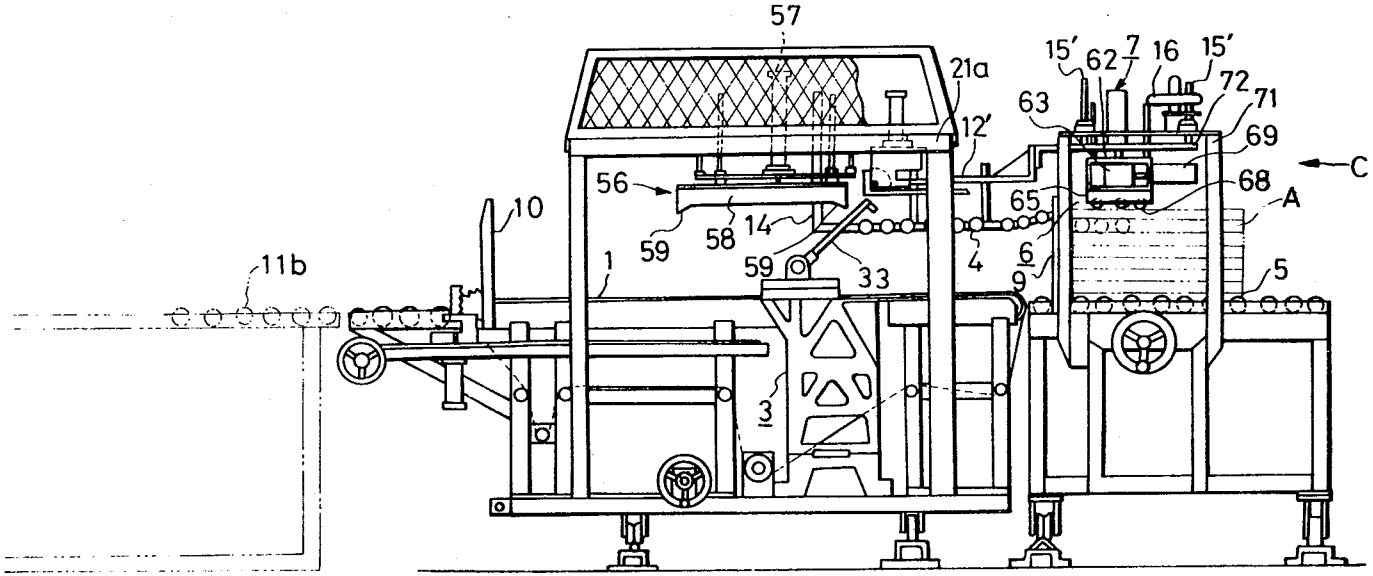
FIG. 6 is a side elevational view of the embodiment shown in FIG. 5.
Figure 7:
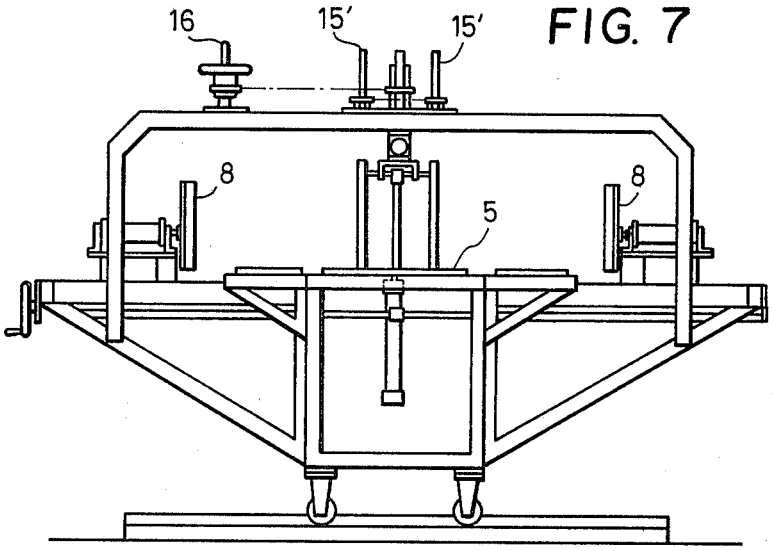
FIG. 7 is a view of a side aligning device of the embodiment shown in FIG. 5 as viewed in the direction of arrow A in FIG. 5.

In feeding the bundle A from the drive roller conveyer 5 to the belt conveyers 1, 1 after pressing the bundle A by the roller carrier 6 of the press 7, the air cylinder 69 is actuated to drive the roller carrier 6 connected to the slide 63 in the direction indicated by arrow C in FIG. 6 in synchronism with the movement of the bundle A. Since the rollers 68 carried by the roller carrier 6 are unrotatable when the roller carrier 6 moves in this direction, the bundle A not only is driven by the conveyer 5 but also receives a pushing force by the rollers 68 at the upper surface of the bundle A. This arrangement ensures transferring of the bundle A from the conveyer 5 to the conveyers 1, 1 and 4 without causing collapse or deformation in the bundle configuration during the high speed feeding of the bundle. After transferring the bundle A to the conveyers 1, 1, the slide 63 and the roller carrier 6 connected thereto are returned to the initial position for the subsequent operation.

While the tying operation is effected by the tying device 3, 3, the press plates 58 compress the bundle A from the upper surface thereof. By virtue of the curved portion 59 provided on the ends of the press plates 58, the compressing of the bundle starts with both end portions of the bundle and extend to the entity of the bundle. Accordingly, the compressing of the bundle A is effected only gradually and damage to the bundle which could be caused by an abrupt compressing can be prevented.

Since the bundle A compressed by the press plate 58 has its upper corner portions elastically deformed to the part cylindrical configuration by the curved portions 59, feeding of the string during the tying operation is not obstructed by the corner portions of the bundle and the string will not cut into the corner portions of the bundle when the string is wrapped around the bundle.

Figure 10:
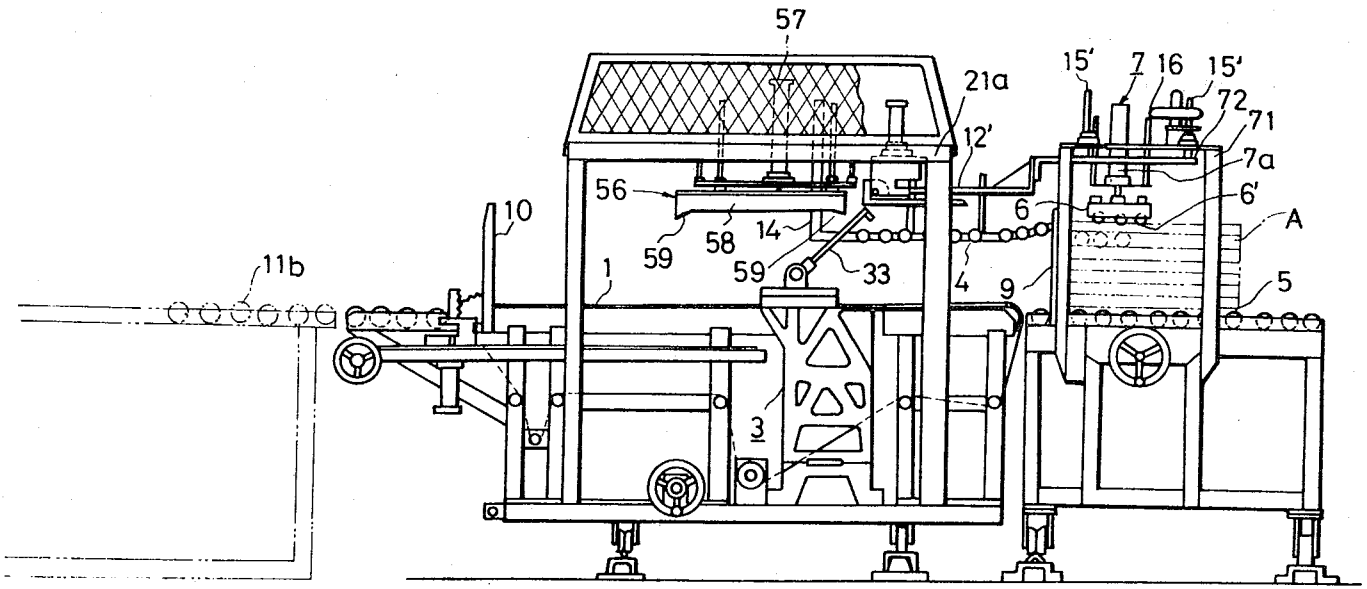
FIG. 10 is a side view of still another embodiment of the tying machine made according to the invention.

FIG. 10 shows still another embodiment of the tying machine according to the invention. This embodiment is the same in structure as the embodiment shown in FIGS. 5 to 9 except that the press 7 is of the type employed in the embodiment shown in FIGS. 1 to 3, i.e., the type in which the roller carrier 6 has free rollers 6'.

We claim:

1. A tying machine comprising a bundle shaping unit including side aligning means for aligning sides of a bundle to be tied, a tying unit including a pair of tying devices disposed opposite to each other for tying a string around the bundle and press means exercising a compressing force upon the bundle to be tied during the tying operation effected by said tying devices, a feeding device for stopping the bundle during the operation of said bundle shaping unit and feeding the bundle from said bundle shaping unit to said tying unit one by one upon completion of each cycle of the operation of said bundle shaping unit, said feeding device including a conveyer portion associated with said tying unit and defining a predetermined linear path of travel of a bundle between said pair of tying devices, and means for moving said pair of tying devices transversely relative to said predetermined linear path of travel selectively away from or toward each other whereby different tying positions for bundles to be tied can be established.

2. A tying machine as defined in claim 1 wherein said bundle shaping unit further comprises press means permitting the bundle having had its sides aligned by side aligning means to move while exercising a compressing force upon the bundle.

3. A tying machine as defined in claim 2 wherein said press means provided in said bundle shaping unit is a press carrying free rollers.

4. A tying machine as defined in claim 2 wherein said press means provided in said bundle shaping unit is a press including a roller carrier which is slideable in a longitudinal direction parallel to a feeding direction of the bundle and drive means for driving said roller carrier in the feeding direction of the bundle and rollers carried by said roller carrier are permitted to rotate only when said roller carrier is moved in a direction opposite to the feeding direction.

5. A typing machine as defined in any of claims 1 to 4 wherein said press means provided in said tying unit includes a press plate provided with a curved portion in at least one end hereof and drive means for vertically moving said press plate.

6. A tying machine as defined in any of claims 2 to 4 wherein said press means provided in said tying unit includes a free roller conveyer which is controlled in a vertical position thereof in accordance with a vertical position of said press means provided in said bundle shaping unit.

7. A tying machine as defined in any of claims 1 to 4 wherein said feeding device includes a drive roller conveyer and a stopper actuated in association with the operation of said bundle shaping unit to engage the bundle while the bundle shaping operation is being effected and disengaged from the bundle upon completion of the bundle shaping operation.

8. A tying machine as defined in any of claims 1 to 4 wherein said tying device includes a wrapping arm which swings between two positions and a string holder provided below said wrapping arm, the string stretched between said wrapping arm and said string holder being wrapped around the bundle to be tied by feeding of the bundle.

9. A tying machine as defined in claim 1 wherein said moving means includes oppositely threaded bars with each of said bars being threadably connected to an associated one of said pair of tying units.

10. The tying machine as defined in claim 9 wherein said conveyer portion is a pair of conveyer belts, one conveyer and one tying unit being carried by a frame at one side of said predetermined linear path and another conveyer belt and tying unit being carried by another frame at an opposite side of said predetermined linear path, and said moving means being threadedly connected by opposite thread means to said frames.

11. The tying machine as defined in claim 10 wherein said moving means includes an oppositely threaded shaft transversely spanning said predetermined linear path.

12. A tying machine as defined in claim 5 wherein said feeding device includes a drive roller conveyer and a stopper actuated in association with the operation of said bundle shaping unit to engage the bundle while the bundle shaping operation is being effected and disengaged from the bundle upon completion of the bundle shaping operation.

13. A tying machine as defined in claim 6 wherein said feeding device includes a drive roller conveyer and a stopper actuated in association with the operation of said bundle shaping unit to engage the bundle while the bundle shaping operation is being effected and disengaged from the bundle upon completion of the bundle shaping operation.

14. A tying machine as defined in claim 5 wherein said tying device includes a wrapping arm which swings between two positions and a string holder provided below said wrapping arm, the string stretched between said wrapping arm and said string holder being wrapped around the bundle to be tied by feeding of the bundle.

15. A tying machine as defined in claim 6 wherein said tying device includes a wrapping arm which swings between two positions and a string holder provided below said wrapping arm, the string stretched between said wrapping arm and said string holder being wrapped around the bundle to be tied by feeding of the bundle.

16. A tying machine as defined in claim 7 wherein said tying device includes a wrapping arm which swings between two positions and a string holder provided below said wrapping arm, the string stretched between said wrapping arm and said string holder being wrapped around the bundle to be tied by feeding of the bundle.

* * * * *

UNITED STATES PATENT AND TRADEMARK OFFICE

CERTIFICATE OF CORRECTION

PATENT NO. : 4,416,196

DATED : November 22, 1983

INVENTOR(S) : Masatoshi Yamada et al

It is certified that error appears in the above-identified patent and that said Letters Patent is hereby corrected as shown below:

On the title page add:
-- [30] Priority data

March 18, 1980 Japan 55-33408 --.

Signed and Sealed this

Seventeenth Day of January 1984

[SEAL]

*Attest:*

GERALD J. MOSSINGHOFF

*Attesting Officer*

*Commissioner of Patents and Trademarks*